US005898754A

United States Patent [19]

Gorzen

[11] Patent Number: 5,898,754

[45] Date of Patent: Apr. 27, 1999

[54] METHOD AND APPARATUS FOR MAKING A DEMOUNTABLE X-RAY TUBE

[75] Inventor: Daniel F. Gorzen, Ann Arbor, Mich.

[73] Assignee: X-Ray and Specialty Instruments, Inc., Ann Arbor, Mich.

[21] Appl. No.: 08/876,052

[22] Filed: Jun. 13, 1997

[51] Int. Cl.[6] ..... H01J 35/02

[52] U.S. Cl. ..... 378/121; 378/123

[58] Field of Search ..... 378/121, 123; 403/272

[56] References Cited

U.S. PATENT DOCUMENTS 4,126,803 11/1978 Bader et al. ..... 378/121
5,402,464 3/1995 Schenk et al. ..... 378/136
5,509,045 4/1996 Kautz ..... 378/123

*Primary Examiner*—David P. Porta
*Assistant Examiner*—David Vernon Bruce
*Attorney, Agent, or Firm*—Young & Basile, P.C.

[57] ABSTRACT

An end mounting (2) for pivotally mounting a housing (5) of a ram (1) to a structure (3) is formed from a single solid piece of material. The end mounting (2) comprises a mounting block (9) which is secured to the structure (3), an end cap (10) which is sealably secured to the housing (5), and a connecting portion (14) which extends between the mounting block (9) and the end cap (10). The connecting portion (14) is of hour-glass shape, cross-section and extends the width of the mounting block (9) to form a plastic hinge. The connection portion (14) defines a pivot axis (18) at the waist (19) of the hour-glass shape about which the end cap (10) and the mounting block (9) are pivotal relative to each other.

18 Claims, 4 Drawing Sheets

FIG-6
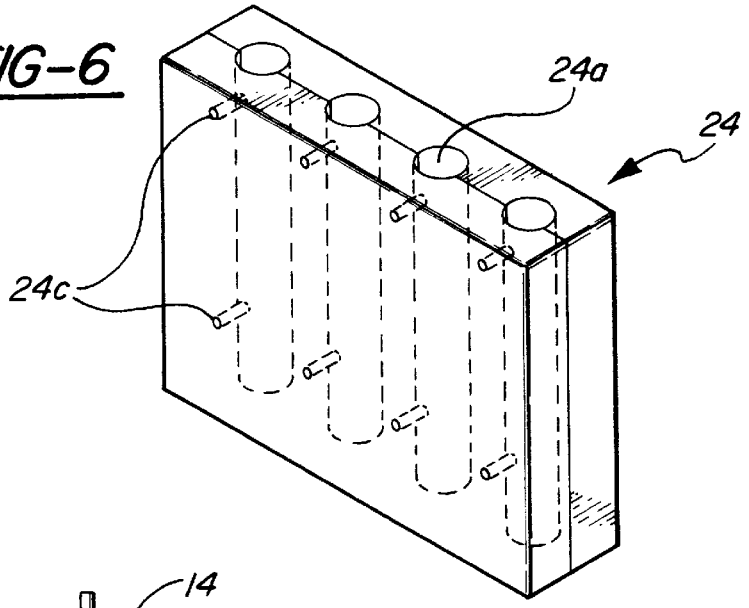
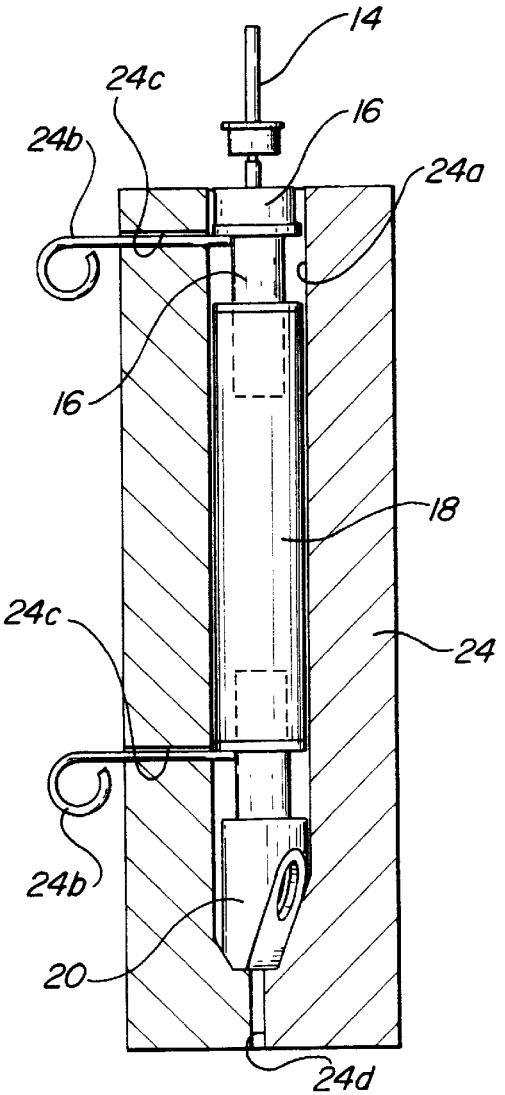
FIG-6A
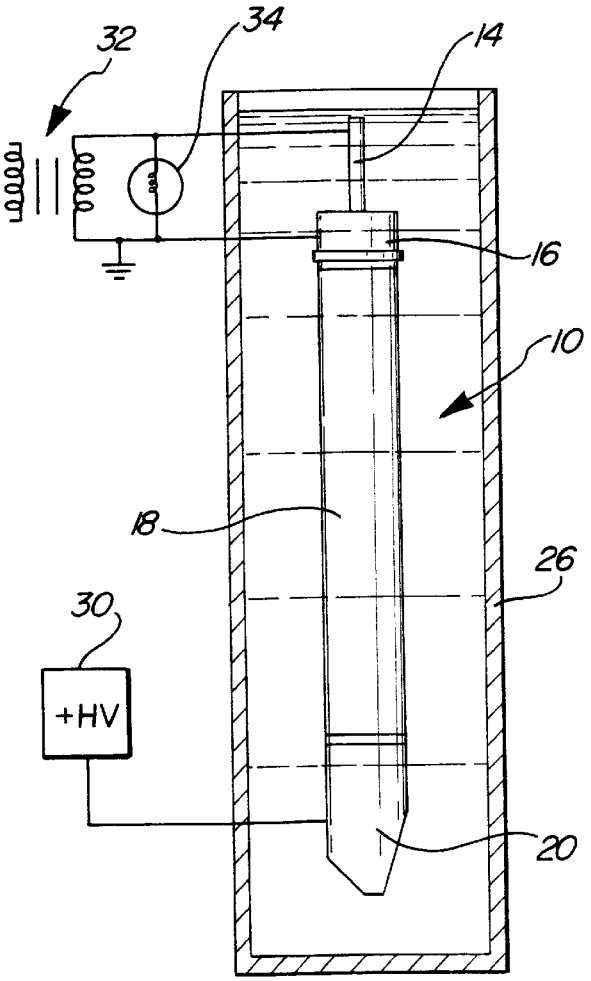
FIG-7

METHOD AND APPARATUS FOR MAKING A DEMOUNTABLE X-RAY TUBE

The present invention relates to an end mounting for a ram housing, and in particular, though not limited to an end mounting for a pneumatic or hydraulic ram housing.

Pneumatic and hydraulic rams, in general, comprise a housing, which typically, though not necessarily is of cylindrical construction and which is closed at respective opposite ends by end caps. A piston is slidable within the housing from end to end, and carries a piston rod which extends through one of the end caps. As the piston slides from end to end within the housing, the piston rod is extended from and retracted into the housing, respectively. In the case of a single acting ram, a single port is located at one end of the cylinder or in the end cap for delivering pneumatic or hydraulic fluid into the ram for urging the piston from one end to the other. A spring returns the piston. In a double acting ram a pair of ports are provided at respective opposite ends of the cylinder or in the end caps for delivering hydraulic or pneumatic fluid into the cylinder for urging the piston in respective opposite directions. Such rams will be well known to those skilled in the art.

Rams of the type described above have many uses. In general, they are anchored to two components of a structure or mechanism for urging the respective components towards and away from each other, or for pivoting thereof. In general, an end mounting is provided towards one end of the housing for mounting the housing of the ram to one of the components. Typically, the end mounting is secured to the end cap through which the piston rod does not project, in other words, to the closed end cap. The piston rod is connected to the other component. In many cases, it is essential that the housing of the ram should be pivotal relative to the component or structure to which the housing is mounted for facilitating pivoting of the housing relative to the structure as the piston cycles from end to end in the housing. This, in general, is achieved by provided a pivot coupling within the end mounting. Such end mountings, in general, comprise a mounting member which extends from the housing or end cap of the ram, typically, from the end cap. A U-shaped mounting bracket which embraces the mounting member, and which is pivotally connected to the mounting member by a clevis pin is provided for mounting to the component to which the ram housing is to be mounted. The clevis pin facilitates pivotal movement between the mounting bracket and the mounting member, and in turn, between the ram and the structure or component to which it is mounted. Circlips, typically secure the clevis pin in the mounting bracket and the mounting member.

Such end mountings, in general, are adequate for accommodating pivotal movement between a ram and the structure to which the ram is mounted in cases where the pivotal movement of the ram relative to the structure is relatively infrequent, and where the speed of pivotal movement required between the ram and the structure is relatively slow, in other words, where the frequency of cycling of the piston within the ram housing is relatively low, and where the cycle time of the piston within the ram housing is relatively long. However, such end mountings, in general, are inadequate where the piston is to cycle within the ram housing at rates in excess of ten cycles per second, and many cycles are required over the life of ram, for example, over one million cycles.

Additionally, because of the fact that such end mountings require so many components, and the fact that the mounting member and mounting bracket are in pivotal engagement with the clevis pin, wear occurs. Such wear can lead to three serious problems. Firstly, the ram may wobble from side to side relative to the structure to which it is mounted, while pivoting about the clevis pin as a result of play between the clevis pin, the mounting member and the mounting bracket. Secondly, and in many cases, more importantly, as a result of wear components may become detached from the end mounting, typically, the circlip and the clevis pin, and where such rams are used in a production environment, the components may fall into the product being produced. Where the product is a food product, this can have serious consequences. Thirdly, wear increases friction in the pivotal coupling of the end mounting, and this thus leads to inefficiency.

There is therefore a need for an end mounting for mounting a ram housing of the type hereinbefore described to a structure or component which overcomes these problems.

The present invention is directed towards providing such an end mounting, and a ram comprising the end mounting.

According to the invention there is provided an end mounting for a ram housing, the end mounting comprising an engagement means for engaging and securing the end mounting to the ram housing, a mounting means for mounting the ram housing to a structure or other component, a connecting means for pivotally connecting the engagement means and the mounting means, the connecting means defining a pivot axis about which the engagement means and mounting means are pivotal relative to each other for facilitating pivotal movement of the ram housing relative to the structure, wherein the end mounting is a one piece end mounting, the engagement means, the mounting means and the connecting means of the end mounting being integrally formed from a single piece of material, and the connecting means is formed by a connecting portion of the material which is resilient for facilitating pivotal movement between the engagement means and the mounting means.

In one aspect of the invention the engagement means and the mounting means are pivotal relative to each other about the pivot axis in only one pivot plane, the pivot axis extending perpendicularly to the pivot plane.

In another aspect of the invention the connecting portion of the material of the end mounting extends longitudinally along the pivot axis for constraining the pivotal movement of the engagement means and the mounting means in the single pivot plane.

In a further aspect of the invention the connecting portion of the material of the end mounting is shaped to form the resilience of the connecting means for facilitating the pivotal movement between the engagement means and the mounting means.

In another aspect of the invention the connecting portion of the material of the end mounting defines an elongated channel which extends the length of the connecting portion of the material along the pivot axis for providing a weakened area of the material for forming the resilience of the connecting means.

In a further aspect of the invention the connecting portion of the material of the end mounting defines a pair of opposing channels extending along the pivot axis for forming the weakened area of the material.

Preferably, the transverse cross-section of the connecting portion of the material of the end mounting when viewed perpendicularly to the pivot plane is of hour-glass shape.

In one aspect of the invention the length of the connecting portion of the material of the end mounting parallel to the pivot axis is substantially similar to the width of the engagement means and the mounting means parallel to the pivot axis.

Ideally, the connecting means retains the engagement means and the mounting means in an equilibrium position with the resilient biasing forces of the connecting means acting on the engagement means and the mounting means being neutral, and on the engagement means and mounting means being pivoted relative to each other from the equilibrium position, the resilient biasing forces of the connecting means acting on the engagement means and the mounting means being such as to urge the engagement means and the mounting means into the equilibrium position.

In one aspect of the invention the engagement means forms an end cap for engaging the ram housing. Preferably, the end cap sealably closes the ram housing at one end thereof. Advantageously, a port for accommodating fluid into and from the ram housing is provided through the end cap. Preferably, the end cap comprises a circumferentially extending side wall for engaging the ram housing, and the port is located in the side wall.

In a further embodiment of the invention the mounting means comprises a mounting block.

In another aspect of the invention the pivot axis in use is disposed perpendicularly to a central axis defined by the ram housing.

Ideally, the mounting means comprises a fastening means for facilitating mounting of the end mounting to the structure of component, and the mounting means defines a fastening bore which forms the fastening means. In one aspect of the invention the fastening bore is threaded for receiving a screw. Preferably, the fastening bore extends perpendicularly to the pivot axis.

Advantageously, the fastening bore is located in the mounting means so that in use a central axis defined by the fastening bore coincides with the central axis of the ram housing.

In one aspect of the invention the material of the end mounting is a plastics material.

Preferably, the material of the end mounting is of a type suitable for forming a plastics hinge.

Additionally, the invention provides a ram comprising a ram housing and an end mounting according to the invention for mounting the ram to a structure or other component.

Preferably, the ram housing is an elongated housing defining an elongated hollow interior region, and a piston is slidably located in the hollow interior region, the end mounting being secured to one end of the ram housing. Advantageously, a piston rod extending from the piston extends from the ram housing at the end remote from the end at which the end mounting is located.

The advantages of the invention are many. A particularly important advantage of the invention is that since the end mounting is formed as a one piece end mounting from a single piece of material, there are thus, no components of the end mounting which can become detached from the end mounting, leading to serious consequential problems, as for example, which can arise in the food industry, should a component of a piece of mechanical apparatus fall into the food material. Additionally, by virtue of the fact that the end mounting is a one piece end mounting formed from a single piece of material, there are no moving parts in the end mounting, for example, there are no moving parts with bearing surfaces which move relative to each other. Thus, frictional forces associated with end mountings which comprise a plurality of moving parts with bearing surfaces which move relative to each other are absent in the end mounting of the present invention. Additionally, by virtue of the fact that the end mounting according to the invention does not comprise components with bearing surfaces which move relative to each other, the end mounting according to the invention is not susceptible to wear. Thus, the problem whereby frictional forces which increase in conventional end mountings due to wear does not arise in the case of the end mounting of the present invention.

In the embodiments of the invention where the connecting portion of the material of the end mounting which forms the connecting means extends for a reasonable length along the pivot axis, the connecting means is relatively rigid in all planes except in the pivot plane. Thus, the engagement means and the mounting means are restrained to pivot in the pivot plane only. Pivoting in any other plane is prevented by the fact that the connecting portion extends for a reasonable length along the pivot axis. This has a particularly important advantage in that there is no danger of the engagement means and the mounting means wobbling relative to each other in planes other than the pivot plane. This has been a particular problem in end mountings known heretofore, particularly, where the bearing surfaces of the components of conventional end mountings commence to wear. Thus, by eliminating wobble, the ram to which the end mounting is connected can be operated with a high degree of accuracy.

Additionally, since the end mounting is a one piece end mounting, construction of the end mounting is a relatively simple and straightforward operation, and it is also relatively inexpensive. In embodiments of the invention where the engagement means also forms an end cap of the ram, a further advantage is achieved in that production and assembly of a ram with the end mounting is considerably simplified, and inexpensive. Furthermore, in such cases, the mounting of the end mounting to the ram can be achieved with the end mounting being relatively accurately located on the ram, and in general, more accurately located than in the case of end mountings of the type known heretofore. Another advantage of the invention is achieved where the connecting means retains the engagement means and the mounting means in an equilibrium position with the resilient forces of the connecting means which act on the mounting means and the engagement means being neutral, and when the engagement means and the mounting means are pivoted relative to each other from the equilibrium position the resilient forces of the connecting means act to return the engagement means and the mounting means to the equilibrium position. The advantage of this feature of the invention is that the ram mounted to the engagement means is urged to return to an equilibrium position each time the ram pivots from the equilibrium position. This, thus, facilitates quick return of the ram to the equilibrium position from either side of the equilibrium position, and it will be appreciated that the further the ram is pivoted about the pivot axis of the connecting means from the equilibrium position, the greater will be the resilient forces of the connecting means acting on the engagement means and the mounting means for returning the ram to the equilibrium position. This thus further facilitates quick return of the ram to the equilibrium position.

Furthermore, by virtue of the fact that the connecting means is resilient, shocks and impacts caused by the piston moving within the ram housing are largely absorbed by the end mounting, and in general, are not transmitted to the structure on which the end mounting is mounted. This, as well as minimizing the transmission of such shocks and impacts, also reduces the noise level of operation of the ram.

By providing the end mounting of a plastics material, a relatively inexpensive end mounting which is relatively easy to machine, mould or otherwise produce and which has a relatively long life is provided. It has been found that by forming the end mounting from a resilient plastics material which is suitable for forming a plastics hinge, the end mounting is capable of accommodating three million pivoting cycles, in other words, the end mounting is capable of facilitating three million pivoting cycles between the engagement means and the mounting means, and furthermore, the end mounting is capable of facilitating thirty pivoting cycles per second, in other words, thirty pivoting cycles of the engagement means and the mounting means relative to each other.

The invention will be more clearly understood from the following description of a preferred embodiment thereof which is given by way of example only with reference to the accompanying drawings, in which:

FIG. 1 is a side elevational view of a ram according to the invention comprising an end mounting also according to the invention, FIG. 2 is a plan view of the ram and end mounting of FIG. 1, FIG. 3 is an end view of the end mounting of FIG. 1 from one end, FIG. 4 is an end view of the end mounting of FIG. 1 from the other end to that of FIG. 3, FIG. 5 is a sectional side elevational view of the end mounting on the line V—V of FIG. 2, FIG. 6 is a sectional plan view of the end mounting on the line VI—VI of FIG. 1, and FIGS. 7(*a*) and 7(*b*) are side elevational views of the ram and end mounting of FIG. 1 illustrated in different positions.

Referring to the drawings there is illustrated a single acting pneumatic ram according to the invention indicated generally by the reference numeral 1 which comprises an end mounting, also according to the invention and indicated generally by the reference numeral 2 for pivotally mounting the ram 1 to a structure 3 or other component, see FIG. 7. The ram 1 comprises an elongated cylindrical housing 5 which is closed at one end by an end cap 6. A piston (not shown) is slidable within the housing 5, and a piston rod 7 connected to the piston (not shown) extends from the cylindrical housing 5 through the end cap 6. Slidable movement of the piston within the housing 5 causes the piston rod 7 to extend from and retract into the housing 5. The operation of such rams will be well known to those skilled in the art.

The end mounting 2 is a one piece end mounting and is integrally formed from one single solid piece of material, which in this case, is a resilient plastics material of the type suitable for forming a plastics hinge. The end mounting 2 comprises a mounting means, namely, a mounting block 9 of square shape in end view for engaging and mounting the ram 1 to the structure 3 as will be described below. An engagement means for engaging the housing 5 of the ram 1 and for mounting the end mounting on the ram 1, in this case, is formed in the shape of a circular end cap 10 for securely engaging and closing an end 11 of the housing 5 opposite to the end which carries the end cap 6. The end cap 10 comprises a base 12 which is formed by the material of the end mounting 2 and a cylindrical side wall 13 for sealably engaging the housing 5 of the ram 1.

A connecting means for pivotally connecting the mounting block 9 and the end cap 10 together comprises a connecting portion 14 which is formed from the same single piece of material which forms the mounting block 9 and the end cap 10, and extends between the mounting block 9 and the end cap 10. The connecting portion 14 is shaped to form a resilient plastics hinge for facilitating pivotal movement between the end cap 10 and the mounting block 9, for in turn facilitating pivotal movement between the ram 1 and the structure 3. The connecting portion 14 extends the width of the end mounting 2 from one side 15 to the other side 16 of the end mounting 2. In other words, the connecting portion 14 extends the width of the mounting block 9, and the width of the diameter of the end cap 10 in plan view. The connecting portion 14 defines a pair of opposed elongated channels 17, also extending the width of the mounting block 9, in other words, the channels 17 extend the width of the connecting portion 14. Thus, the connecting portion 14 is of constant cross-section of hour-glass shape along its length from the side 15 to the side 16, and defines a pivot axis 18 adjacent a waist 19 of the hour-glass shape about which the end cap 10 and the mounting block 9 are pivotal in a single pivot plane 20. The pivot axis 18 extends parallel to the waist 19 and the channels 17, and perpendicularly to the pivot plane 20.

By virtue of the fact that the connecting portion 14 extends the width of the end mounting 2 along the pivot axis 18, the connecting portion 14 provides rigidity between the end cap 10 and the mounting block 9 in all planes except the pivot plane 20. Thus, the connecting portion 14 facilitates pivoting of the end cap 10 relative to the mounting block 9 about the pivot axis 18 in the pivot plane 20, but constrains the end cap 10 and the mounting block 9 to pivot only in the pivot plane 20. Thereby, the possibility of wobble between the end cap 10 and the mounting block 9 from side to side on either side of the pivot plane 20 is effectively eliminated.

The resilience of the connecting portion 14 is such that the connecting portion 14 retains the end cap 10 and the mounting block 9 in an equilibrium position illustrated in FIGS. 1 and 2. In this position, the resilient biasing forces of the connecting portion 14 acting on the end cap 10 and the mounting block 9 are neutral. However, on the end cap 10 and the mounting block 9 being pivoted relative to each other from the equilibrium position, the resilient biasing forces in the connecting portion 14 act on the end cap 10 and the mounting block 9 to urge and return the end cap 10 and the mounting block 9 to their equilibrium position. The resilient forces in the connecting portion 14 are such that the resilient forces urging the end cap 10 and the mounting block 9 back to their equilibrium position increase the further the end cap 10 and the mounting block 9 are moved from the equilibrium position. This thus ensures quick return of the end cap 10 and the mounting block 9 to the equilibrium position, when an external force which has urged the end cap 10 and the mounting block 9 out of their equilibrium position has been removed. Accordingly, the end mounting 2 retains the ram 1 in a equilibrium position relative to the structure 3, when the end cap 10 and the mounting block 9 are in their equilibrium position. Thus, on the ram 1 being pivoted from the equilibrium position about the pivot axis 18 of the end mounting 2 as a result of the movement of the piston rod 7 relative to the housing 5, on the piston rod 7 being returned to a position which corresponds to the equilibrium position of the ram 1 and the structure 3, the action of the connecting portion 14 on the end cap 10 and the mounting block 9 rapidly assists the return of the ram 1 to its equilibrium position relative to the structure 3.

A fastening means provided by a threaded bore 24 extends into the mounting block 9 for accommodating a screw 25, for securing the mounting block 9 to the structure 3, see FIG. 7. A fluid port 27 is provided through the side wall 13 of the end cap 10 for accommodating pneumatic fluid into and out of the housing 5. A corresponding opening (not shown) is formed in the housing 5 of the ram 1 and is aligned with the fluid port 27 for accommodating pneumatic fluid into the housing 5. Typically, a bore 29 formed by the side wall 13 of the end cap 10 may be threaded for tightly and sealably engaging corresponding threads (not shown) on the housing 5 for securing the end cap 10 to the housing 5.

The dimensions of the end mounting 2 will vary depending on the size, weight and other parameters of the ram 1, and in particular, the length l, the width w, and the thickness t of the connecting portion 14, see FIGS. 5 and 6, will vary. However, in this embodiment of the invention the ram 1 comprises a housing 5 of 19 mm diameter. The length l of the connecting portion 14 is 25 mm. The width w of the connecting portion 14 is 20 mm, and the thickness t of the connecting portion at the waist 19 is 4.8 mm. These dimensions are solely given for the purpose of illustration, and in no way are intended to limit the scope of the invention.

In use, the end mounting 2 is secured to the housing 5 of the ram 1 by engaging the housing 5 in the bore 29 of the end cap 6. Any suitable sealable securing means for securing the housing 5 in the end cap 6 may be used, as discussed above, the bore 29 may be threaded for engaging corresponding threads (not shown ) on the housing 5. The ram 1 is mounted on the structure 3 by securing the mounting block 9 to the structure 3 by the screw 25. The ram 1 and the end mounting 2 are oriented so that the pivot axis 18 is aligned with the axis about which the ram 1 is to pivot and the screw 25 is then securely tightened in the mounting block 9. The piston rod 7 is secured to a linkage or other component (not shown) which is to be operated by the piston rod 7. As the ram 1 is operated and the piston rod 7 extends from and is retracted into the housing 5, the ram 1 pivots relative to the structure 3 about the pivot axis 18 of the end mounting 2. As discussed above the resilient forces of the connecting portion 14 which act on the mounting block 9 and the end cap 6 when the mounting block 9 and the end cap 10 are pivoted from their equilibrium position, act to return the ram 1 to its equilibrium position as the ram 1 is moved therefrom. In FIG. 7(*a*) the ram 1 is illustrated having pivoted to one extreme position about the pivot axis 18 in the pivot plane 20, while in FIG. 7(*b*) the ram 1 is illustrated having pivoted to the opposite extreme position in the pivot plane 20 about the pivot axis 18.

While the mounting means has been described as being a mounting block and the engagement means has been described as being an end cap, the mounting means and engagement means may be provided in other shapes, forms and constructions. It is not essential although, it is preferable, that the engagement means should form an end cap of the ram.

While a particular shape of connecting portion of the end mounting has been described, the connecting portion may be of other suitable shapes. While it is preferable that the connecting portion should extend longitudinally along the pivot axis for a reasonable distance to avoid sideward wobbling, it is not essential that the connecting portion should extend the full width of the mounting block and/or the end cap. In certain cases, should it be desired that the connecting portion facilitate pivoting of the engagement means relative to the mounting means about more than one axis, for example, it may be desirable that the mounting means and the engagement means be pivotal about two axes at right angles to each other, in such a case, the connecting means would be suitably shaped, and for example, may be of hour-glass shape when viewed both in side elevation and in plan view. It is also envisaged that the connecting means may be arranged for pivoting the mounting means and the engagement means universally relative to each other.

While the material of the end mounting has been described as being a resilient plastics material, any other suitable material may be used, provided it is a resilient material and capable of accommodating many pivoting cycles, or provided the material of the end mounting can be shaped at the connecting means for forming a resilient connecting portion.

We claim:

1. A ram comprising an end mounting (2) and a ram housing (5), the end mounting (2) comprising an engagement means (10) for engaging and securing the end mounting (2) to the ram housing (5), a mounting means (9) for mounting the ram housing (5) to a structure (3), a connecting means (14) for pivotally connecting the engagement means (10) and the mounting means (9), the connecting means (14) defining a single pivot axis (18) about which the engagement means (10) and mounting means (9) are pivotal relative to each other for facilitating pivotal movement of the ram housing (5) relative to the structure (3), characterized in that the engagement means (10) and the mounting means (9) are pivotal relative to each other about the pivot axis (18) in only one pivot plane (20), the pivot axis (18) extending perpendicularly to the pivot plane (20) and the end mounting (2) is a one piece end mounting (2), the engagement means (10), the mounting means (9) and the connecting means (14) of the end mounting (2) being integrally formed from a single piece of material, and the connecting means (14) is formed by a connecting portion (14) of the material which is resilient for facilitating pivotal movement between the engagement means (10) and the mounting means (9).

2. A ram mounting as claimed in claim 1 characterised in that the connecting portion (14) of the material of the end mounting (2) extends longitudinally along the pivot axis (18) for constraining the pivotal movement of the engagement means (10) and the mounting means (9) in the single pivot plane (20).

3. A ram mounting as claimed in claim 1 characterised in that the connecting portion (14) of the material of the end mounting (2) is shaped to form the resilience of the connecting means (14) for facilitating the pivotal movement between the engagement means (10) and the mounting means (9).

4. A ram mounting as claimed in claim 3 characterised in that the connecting portion (14) of the material of the end mounting (2) defines an elongated channel (17) which extends the length of the connecting portion of the material along the pivot axis (18) for providing a weakened area of the material for forming the resilience of the connecting means (14).

5. A ram mounting as claimed in claim 4 characterised in that the connecting portion (14) of the material of the end mounting (2) defines a pair of opposing channels (17) extending along the 10 pivot axis (18) for forming the weakened area of the material.

6. A ram mounting as claimed in claim 3 characterised in that the transverse cross-section of the connecting portion (14) of the material of the end mounting (2) when viewed perpendicularly to the pivot plane (20) is of hour-glass shape.

7. A ram mounting as claimed in claim 1 characterised in that the length of the connecting portion (14) of the material of the end mounting (2) parallel to the pivot axis (18) is substantially similar to the width of the engagement means (10) and the mounting means (9) parallel to the pivot axis (18).

8. A ram mounting as claimed in claim 1 characterized in that the connecting means (14) retains the engagement means (10) and the mounting means (9) in an equilibrium position with a resilient biasing force of the connecting means (14) acting on the engagement means (10) and the mounting means (9) being neutral, and on the engagement means (10) and mounting means (9) being pivoted relative to each other from the equilibrium position, the resilient biasing force of the connecting means (14) acting on the engagement means (10) and the mounting means (9) being such as to urge the engagement means (10) and the mounting means (9) into the equilibrium position.

9. A ram mounting as claimed in claim 1 characterized in that the engagement means (10) forms an end cap (10) for engaging the ram housing (5), and the end cap (10) sealably closes the ram housing (5) at one end (11) thereof.

10. A ram mounting as claimed in claim 9 characterised in that a port (27) for accommodating fluid into and from the ram housing (5) is provided through the end cap (10).

11. A ram mounting as claimed in claim 10 characterised in that the end cap (10) comprises a circumferentially extending side wall (13) for engaging the ram housing (5), and the port (2) is located in the side wall (13).

12. A ram mounting as claimed in claim 1 characterised in that the mounting means (9) comprises a mounting block (9).

13. A ram mounting as claimed in claim 1 characterised in that the pivot axis (18) in use is disposed perpendicularly to a central axis defined by the ram housing (5).

14. A ram mounting as claimed in claim 1 characterized in that the mounting means (9) comprises a fastening means (24, 25) for facilitating mounting of the end mounting (2) to the structure (3).

15. A ram mounting as claimed in claim 14 characterized in that the mounting means (9) defines a fastening bore (24) which forms the fastening means (24, 25), and the fastening bore (24) is threaded for receiving a screw (25), and the fastening bore (24) extends perpendicularly to the pivot axis (18).

16. A ram mounting as claimed in claims 14 characterised in that the fastening bore (24) is located in the mounting means (9) so that in use a central axis defined by the fastening bore (24) coincides with the central axis of the ram housing (5).

17. A ram as claimed in claim 1 characterised in that the material of the end mounting (2) is a plastics material, and is of a type suitable for forming a plastics hinge.

18. A ram as claimed in claim 1 characterised in that the ram housing (5) is an elongated housing (5) defining an elongated hollow interior region, and a piston is slidably located in the hollow interior region, the end mounting (2) being secured to one end (11) of the ram housing (5), and a piston rod (7) extending from the piston extends from the ram housing (5) at the end remote from the end (11) at which the end mounting (2) is located.

* * * * *

UNITED STATES PATENT AND TRADEMARK OFFICE

CERTIFICATE OF CORRECTION

PATENT : 5,898,754

DATED : Apr. 27, 1999

INVENTOR(S) : Daniel F. Gorzen

It is certified that error appears in the above-identified patent and that said Letters Patent is hereby corrected as shown below:

The title page and columns 1-10 should be deleted and substitute therefor the attached title page, showing [57] ABSTRACT and columns 1-10, as corrected.

US004002018A

United States Patent [19]

Gorzen

[11] Patent Number: 5,898,754

[45] Date of Patent: Apr. 27, 1999

[54] METHOD AND APPARATUS FOR MAKING A DEMOUNTABLE X-RAY TUBE

[75] Inventor: Daniel F. Gorzen, Ann Arbor, Mich.

[73] Assignee: X-Ray And Specialty Instruments, Inc., Ann Arbor, Mich.

[21] Appl. No.: 08/876,052

[22] Filed: Jun. 13, 1997

[51] Int. Cl.[6] ..... H01J 35/02

[52] U.S. Cl. ..... 378/121; 378/123

[58] Field of Search ..... 378/121, 123; 403/272

[56] References Cited

U.S. PATENT DOCUMENTS

| | | | |
|---|---|---|---|
| 4,126,803 | 11/1978 | Bader et al. | 378/121 |
| 5,402,464 | 3/1995 | Schenk et al. | 378/136 |
| 5,509,045 | 4/1996 | Kautz | 378/123 |

*Primary Examiner*—David P. Porta
*Assistant Examiner*—David Vernon Bruce
*Attorney, Agent, or Firm*—Young & Basile, P.C.

[57] ABSTRACT

The invention includes a method for forming an x-ray tube so that it is demountable, by securing and hermetically sealing airtight cathode and anode assemblies to the ends of the tube body with solder, such that during operation the tube requires no external vacuum pump. The mating surfaces of the cathode and anode are wet with solder and the components are loosely preassembled in a mold such that the solder-wetted surfaces are held apart from the tube body. The mold is then placed in a vacuum and heated to drive gases from the tube body, and the solder-wetted surfaces are brought into assembled contact to seal the tube. The sealed tube is held at elevated temperatures to liberate absorbed residual gases which are captured in a heated getter. The invention also includes a demountable x-ray tube manufactured according to the above-described method.

18 Claims, 4 Drawing Sheets

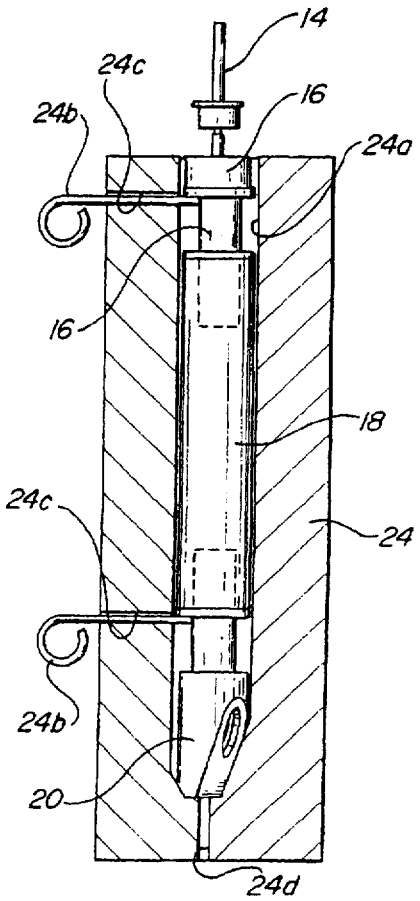

METHOD AND APPARATUS FOR MAKING A DEMOUNTABLE X-RAY TUBE

FIELD OF THE INVENTION

The present invention relates generally to x-ray tube manufacturing techniques, and more particularly to methods for making hermetically sealed x-ray tubes.

BACKGROUND OF THE INVENTION

Conventional x-ray tubes typically use glass-to-metal seals or ceramic-to-metal brazed joints which are permanent and cannot be unsealed without destroying the tube. In glass-to-metal tubes, a glass tube is sealed to an expansion matched metal tube using a "housekeeper's seal", in which a sharpened edge of the metal tube is pushed into the heated glass tube material to make a hermetic seal. In ceramic-to-metal tubes, the ceramic is brazed to the metal after first being coated with a thin film of braze-enabling metal.

Certain soldering-type techniques are known in the night vision image intensifier tube art for securing anodes and cathodes to tubes, but such soldering techniques have not been successfully adapted to the manufacture of x-ray tubes.

There are two conventional methods for pumping out conventional x-ray tubes to high vacuum: glass or copper pinch-off. Both methods require "one-off" pumpout, meaning that each tube must be provided with its own pumpout tubulation (PT) and be individually evacuated. With a glass tube, withdrawal of the PT from the heated, evacuated tube results in the self-sealing collapse of the tube. With a metal tube, a copper PT is simply pinched off where it exits the metal body to form a cold weld seal.

In recent years there has been an increasing demand for small x-ray tubes, commonly known as "ultrasmall" or "micro" x-ray tubes, typically less than one inch in diameter and only a few inches long. These micro tubes are used to replace radio-active elements for portable gauging, fluorescence, and imaging devices. The tube is supplied with a miniature portable power supply of known type.

Problems have been found, however, with respect to the manufacture of x-ray tubes, especially small "micro" tubes, including difficulties with the conventional methods for pumping the tubes out to vaccum, and with respect to the conventional seals which prevent "demounting" of the cathode and/or anode for tube repair or reconditioning.

A further drawback in known manufacturing methods for x-ray tubes is in the slow, one tube at a time process for making them, which increases their cost significantly.

SUMMARY OF THE INVENTION

It is a general object of the invention to provide a method for manufacturing demountable x-ray tube seals, and especially demountable seals for micro x-ray tubes.

It is a further object of the present invention to provide a method for sealing x-ray tubes such that they can be evacuated and sealed in batches rather than one at a time.

In general the above objects are achieved by providing a tube assembly with mating joint surfaces that can be soldered together by wetting the joint surfaces with solder (preferably indium solder) and loosely preassembling them in an alignment mold or jig. The mold alignment is subject to a vacuum, and the tube is heated until internal gases have been evacuated through the loosely preassembled tube assembly. During the heating phase the loosely preassembled pieces are pushed together for a solder seal between mating joint surfaces. A "getter" material in the tube continues to eliminate residual gas even as the tube cools off.

This method produces a fully demountable x-ray tube, even in "micro" size, in which reheating the tube remelts the solder and permits it to be disassembled for repair or reconditioning, or to be customized with different anodes.

The invention also includes a method for batch processing the tubes by providing multiple-tube molds for holding the preassembled, solder-wetted tube assemblies.

These and other features and advantages of the invention will become apparent upon review of the following drawings and specification.

BRIEF DESCRIPTION OF THE DRAWINGS

FIG. 6 is a perspective view of a mold used in batch processing of tube assemblies as shown in FIG. 1;

FIG. 6A is an end section view of a portion of the evaculation mold in FIG. 6, with an x-ray tube assembled according to the present invention loosely preassembled therein for a first heat processing step;

DETAILED DESCRIPTION OF THE ILLUSTRATED EMBODIMENTS

Figures 1, 1A, 1B:
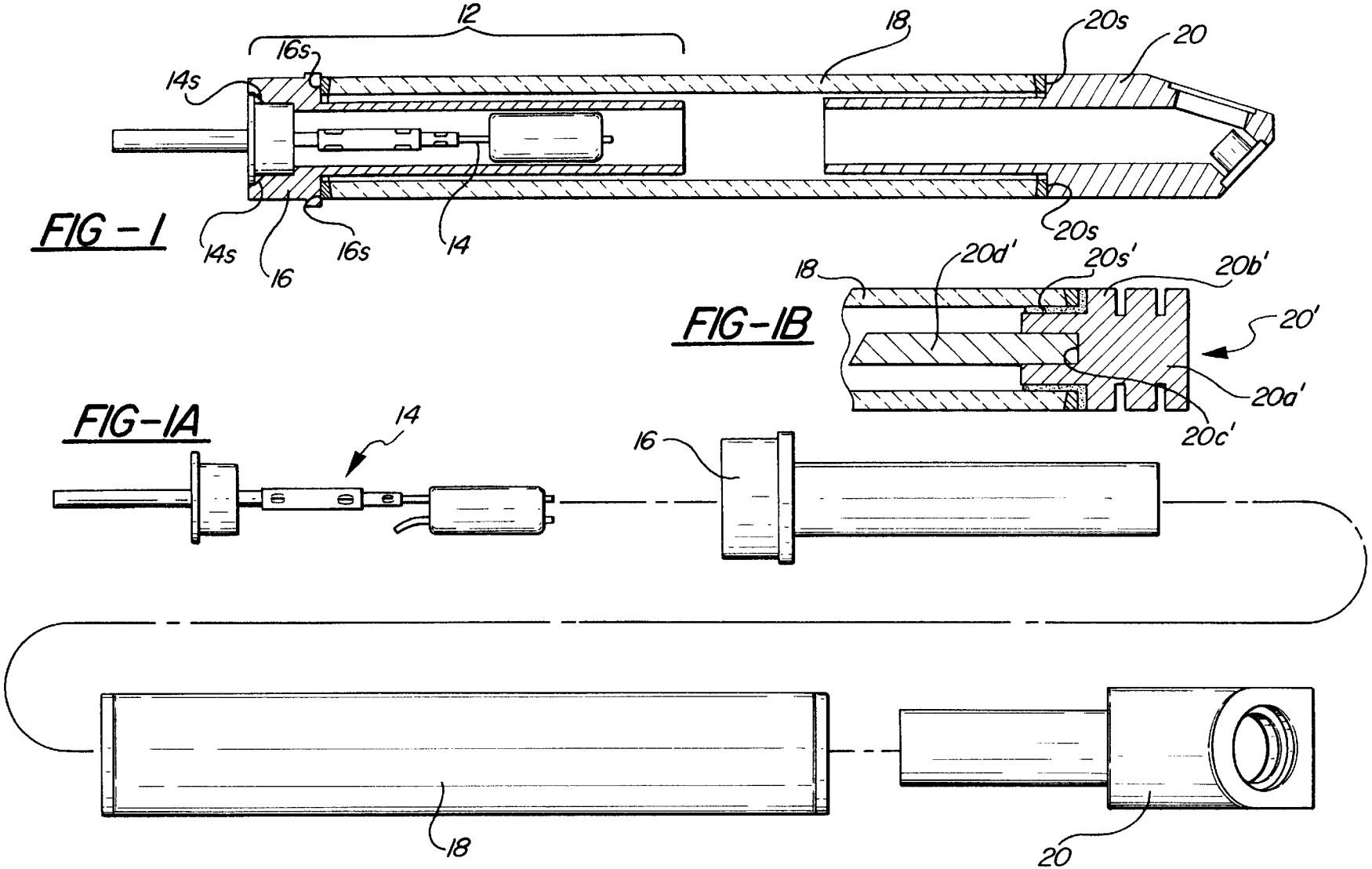
FIG. 1 is a side view of an assembled micro x-ray tube according to the present invention.
FIG. 1A is an exploded assembly view of the components of the tube in FIG. 1, rotated 90°.
FIG. 1B is a side section view of the anode end of the tube of FIG. 1 with an alternate anode.

Referring first to FIGS. 1 and 1A, the component parts of a micro x-ray tube assembly are illustrated both assembled (FIG. 1) and individually in an exploded view (FIG. 1A). The micro x-ray tube 10 comprises an electron gun assembly 12 including a filament 14 and an electron gun body 16, which form the cathode; a ceramic tube body 18, for example aluminum oxide; and an anode 20. The mating surfaces or joints between individual components which are critical for maintaining the vacuum seal integrity of the tube are sealed with solder using a method described below. In particular, solder seals between filament assembly 14 and electron gun body 16; electron gun assembly 12 and tube body 18; and end anode 20 and the other end of tube body 18 can be reheated to permit removal of the cathode and/or anode for tube reconditioning, repair, or customization with different types of anodes and cathodes.

Figure 1C:
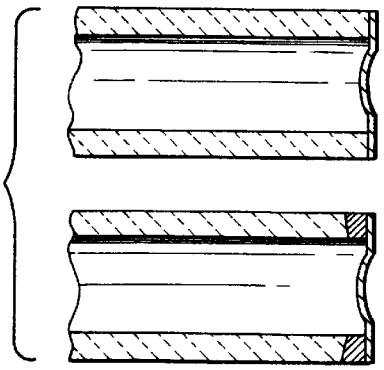
FIG. 1C is a side section view of the anode end of the tube of FIG. 1 with a second alternate anode.

FIG. 1B illustrates an alternate anode 20' of a type commonly used in micro tubes, and is described in greater detail below. FIG. 1C illustrates a second alternate anode 20" of a type which is not believed to have been previously known, and is described in greater detail below.

For a clear understanding of the relationship between each component in the micro tube assembly, the assembly and preparation of each component will first be described before explaining the method of soldering the components into a sealed tube assembly, which in the present invention is done to all of the components at once in a loosely preassembled state.

Figure 2:
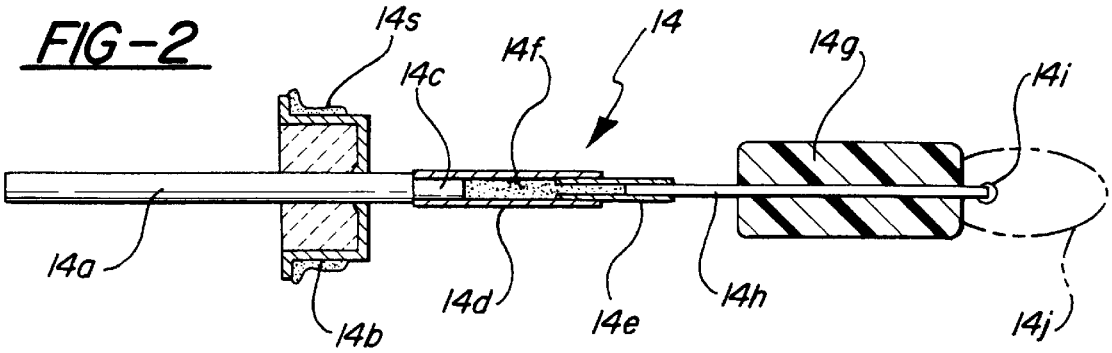
FIG. 2 is a side section view of the filament assembly of the tube in FIG. 1.

Referring now to FIG. 2, the filament assembly 14 of the x-ray tube in FIG. 1 is shown in side section. A Cerameseal single pin electrical feedthrough (or equivalent) **14*b* is wet with indium solder using a soldering iron and a stainless steel soldering flux. The center pin 14*c* of the vacuum side of the Cerameseal feedthrough is ground down in the illustrated embodiment to 0.030 inches diameter, and a short length 14*d*** of 0.030 inch inner diameter (I.D.) stainless steel tubing is crimped to it using a four point pin crimping tool of known type (not shown).

Next, a 0.030 inch outer diameter (O.D.) stainless steel tube **14*e* is crimped at one end onto one lead 14*h* of a flashlight bulb, in the illustrated embodiment a AA "Maglite"™ bulb, while the other lead (shown in FIG. 1A) is bent outward at an angle. At this point in assembly, the glass 14*j* of the flashlight bulb 14*g* is left intact to protect filament 14*i***.

The components of filament assembly 14 are fit together so that the overall length of the assembly can be checked. The components are then disassembled and chemically cleaned, for example using an ultrasonic bath of microsoap and water, then a rinse of distilled water, then a further rinse with filter ethanol or methanol. After drying the clean components, the stainless steel tube **14*d* is filled with a known type of getter material, SAES type 303 or equivalent. Preferably, both tubes 14*d* and 14*e*** are filled with getter material.

The two getter-filled tubes **14*d* and 14*e* are next slip fit together and the total length of the filament assembly adjusted by sliding the tubes so that the filament 14*i* will be positioned a known distance behind the emitter end of the electron gun (FIG. 1). Tubes 14*d* and 14*e* are then crimped together, and the glass bulb portion 14*j* of bulb 14*g*** is removed, for example pinched off with a pair of diagonal cutters.

Figure 3:
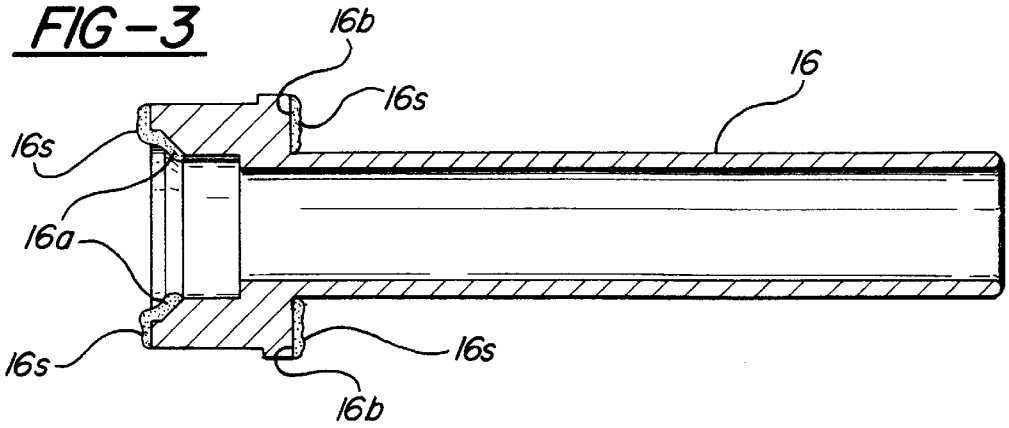
FIG. 3 is a side section view of the electron gun body in the tube of FIG. 1.

Referring now to FIG. 3, the electron gun body 16 has its inner and outer sealing surfaces **16*a*, 16*b* wet with indium solder 16*s*** using a soldering iron and stainless steel soldering flux.

Once the solder has been applied, the electron gun body 16 is chemically cleaned and set aside for later assembly.

While the illustrated embodiment has been described so far as using indium solder, it is also possible to use different solders such as 50/50 PbSn or silver solder if higher temperature joints are desired. However, these materials are not as effective at achieving an ultrahigh vacuum due to their somewhat higher vapor pressures than the indium solder material.

Figure 4:
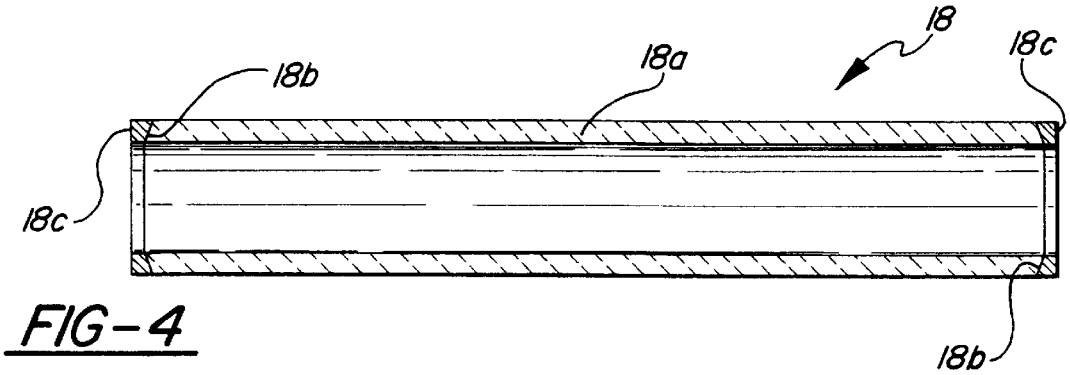
FIG. 4 is a side section view of the tube body of the assembly in FIG. 1.

Referring now to FIG. 4, tube body 18 comprises a known aluminum oxide material (or optionally beryllium oxide if higher x-ray transmission through the body is desired using a center anode, described below). In the illustrated embodiment, the tube is a commerically available aluminum oxide material, with dimensions of 3/16 inch inner diameter; 1/4 inch outer diameter; and 1.70 inches in length. The ends of tube 18 are wet ground to a desired angle (e.g., 22°) using diamond abrasive and then polished with silicone carbide wet sandpaper. The angled ground ends **18*b* are then capped with a mating ring of Kovar or 42 alloy material 18*c* which has been previously chemically cleaned. Caps 18*c* are secured in sealing fashion to the angled ends 18*b* of the tube with a brazing compound suitable for brazing ceramic to metal, applied to the angled ends of the tube and the inner ends of the metal caps 18*c***, with the parts press fit together.

Next, the assembled tube and caps are put through a brazing cycle, during which a weight is used to press the parts together while they are brazed at approximately 900° C. in a vacuum furnace at a base pressure of, preferably, $1\times10^{-5}$ torr or better. It will be apparent to those skilled in the art that while a preferred braze and press-fit metal to ceramic joint is illustrated, other known metal to ceramic joining techniques can be used.

The ends of the brazed parts are then ground to be orthogonal to the centerline of the ceramic tube body **18*a***, and are preferably soldered to a short copper tube and an end plate in known fashion so that they can be helium leak checked. Alternately, the ends of the tube can be sealed with elastomer seals or by other known methods for leak checking.

In the illustrated embodiment, tubes with detectable leaks (for example $1\times10^{-10}$ atm liters $cm^3$/sec) are discarded. For tubes 18 which pass the leak test, the leak checking end seals and pumpouts are removed, the ends of the tube are wet with a small excess of indium solder, and then the entire tube 18 is chemically cleaned.

Figure 5:
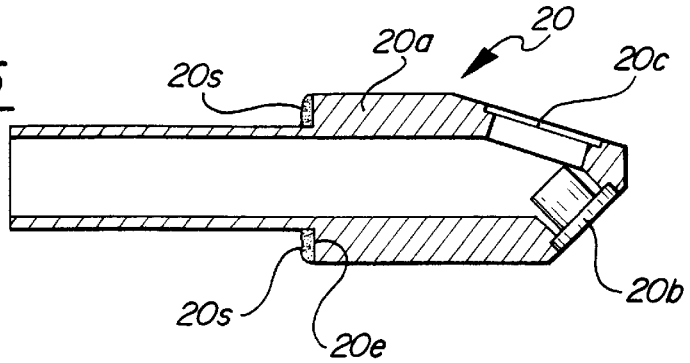
FIG. 5 is a side section view of the anode in the assembly of FIG. 1.
Figure 5A:
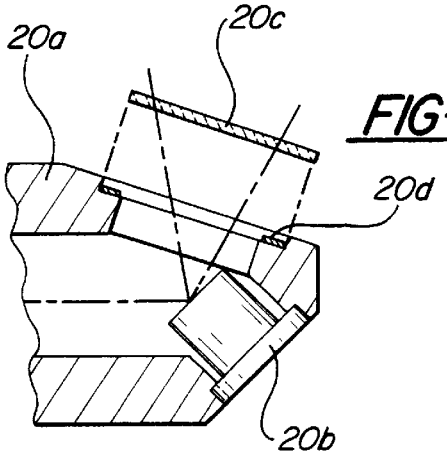
FIG. 5A schematically represents a step in the assembly of the end anode in FIG. 5.

Referring now to FIGS. 5 and 5A, the anode 20 which caps off the other end of the micro x-ray tube is shown in a preferred end anode configuration for directing x-rays from the end of the tube. In FIG. 5, end anode 20 comprises a stainless steel body **20*a*, for example a 304 or 413 stainless steel body; a solid anode of known type, for example comprising tungsten, molybdenum, titanium, iron, or chromium, to name a few examples. End anode 20 also includes an emitter window 20*c* adjacent solid anode 20*b*** for the directed emission of x-rays.

In the illustrated embodiment end anode body **20*a* is formed from a single piece of 304 or 413 stainless steel or oxygen free copper. Solid anode 20*b* is illustrated as directly vacuum brazed onto a suitable cutout in body 20*a*, using the same brazing material mentioned above in FIG. 4. The emitter window 20*c* as illustrated is formed from beryllium, is shown on the order of 0.010 inches thick, and is also directly brazed onto the stainless steel anode body 20*a* using braze in the form of a gasket 20*d*, best shown in FIG. 5A. The beryllium window 20*c* is preferably held down with a slight clamping force during the vacuum braze cycle (for example, 850° C. rapid temperature cycle to minimize alloying of beryllium with the braze compound). End anode 20 is then leak checked in a manner similar to that described above for tube body 18, wet with indium solder 20*s* on face 20*e***, and chemically cleaned.

Alternate center anode 20', illustrated in FIG. 1B, is an optional alternative to end anode 20 where it is desired to have the micro x-ray tube emit x-rays radially through the ceramic tube body **18*a*, rather than endwise through an end anode. In FIG. 1B, center anode 20' comprises a solid copper end plug 20*a'* preferably formed from an oxygen free (OFHC) copper having a plurality of fins 20*b'*, a blind bore or cup portion 20*c'*, and a short length of tungsten rod 20*d'* vacuum brazed into the cup. The free end of rod 20*d'*** is ground to an appropriate length and desired angle (for example 22° as illustrated), and finished by polishing, for example using a diamond grit polishing paste. Center anode 20' is wet with indium solder on its tube-mating face, and then chemically cleaned.

FIG. 1C illustrates an alternate, non demountable, end anode 20" comprising a thin foil of molybdenum, tantalum, or other foil either directly brazed onto the ceramic tube body 18*a*, or indirectly brazed via an intermediary gasket of Kovar or 42 metal.

It will be understood by those skilled in the art that the foregoing specific examples of components for the micro x-ray tube assembly, and their size, shape, material and preparation techniques, are but illustrative examples of preferred embodiments, and that known equivalent components and micro x-ray tube structures can be used with the inventive assembly method.

One alternate method of sealing the x-ray tube ends instead of the brazed Kovar caps uses a gold metal organic ink used to bake a metallic film onto the ceramic tube ends. Rather than wetting the Kovar caps with indium, the indium on the mating part wets to the noble metal film in vacuum. Another method applies a cold compression seal to the bare ceramic of the tube end. After the vacuum bake, the ceramic can be forcefully rammed into the indium, forming the seal.

The chemically cleaned components of the micro x-ray tube assembly can now be assembled. It will be understood by those skilled in the art that the handling of the clean parts in the assembly process is preferably done with gloved hands in a clean environment, for example on a class 100 clean bench.

Referring now to FIGS. 7 and 7A, the present invention is illustrated using a multiple-tube split alignment mold made, for example, from aluminum or graphite. Mold 24 is illustrated as being able to process four micro tubes at a time, although it will be apparent that any number of tubes can be assembled at one time depending merely on the size of the mold. It is of course possible, although less desirable, to assemble only one tube at a time. Referring to FIG. 6A, the details of alignment mold 24 include a cylindrical tube cavity 24*a* having a diameter approximating the outside diameter of the tube body 18, and a lower end shaped to receive anode 20. In the alignment mold 24 the parts are inserted at the preferred orientation and spacer pins 24*b* are inserted through holes 24*c* in the sidewall of the mold body so that the indium-wet mating seal surfaces of the micro tube are held apart from one another. At this stage the tube assembly is in a loosely preassembled state.

Next, the preassembled tube assembly and the alignment mold 24 are placed in a vacuum chamber and pumped to vacuum, for example 1×10–6torr. The tube assembly and the alignment mold are then heated to and held at 350° C., and after two hours the pins are removed. The filament assembly 14 is pressed into the electron gun body 16 using a wiggle stick or some other actuator in the vacuum. The tube assembly is maintained at a temperature of 350° C. for an additional two hours and then allowed to cool to room temperature. During the first part of the bake cycle, absorbed gases are driven out of the x-ray tube and removed by the vacuum pump. After the parts are pressed together the solder forms a gas tight barrier such that any residual gas molecules in the tube are captured by the getter material.

Also, during the bake cycle the getter material is activated so that even when the tube returns to room temperature the getter continues to capture any residual gases left in the tube.

The above-described procedure is the same whether end anode 20, center anode 20' (FIG. 1B) or alternate end anode 20" (FIG. 1C) is used.

The above-described method produces a fully demountable x-ray tube, in which reheating the tube melts the solder and permits it to be disassembled for repair or reconditioning, or even customized with different anodes. The invention also permits batch processing of tubes in multiple-tube molds, in contrast to the one-off methods of the prior art. The method is non-invasive of the tube, and does not waste any material as in the copper pinch-off prior art method. And, as stated above, the inventive method lends itself to making very small micro tubes which can replace undesirable radioactive sources.

Figure 6B:
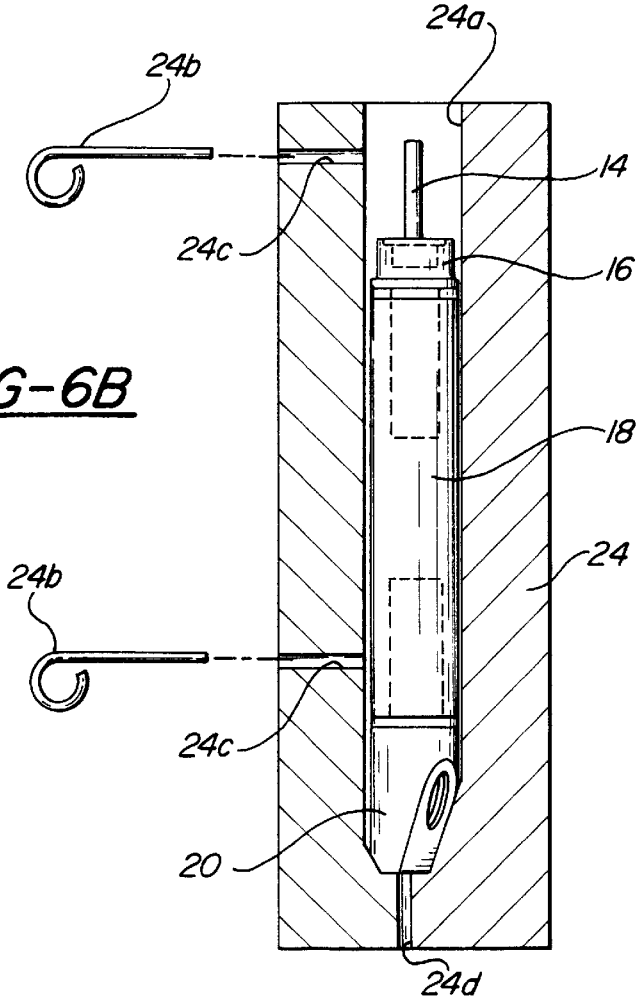
FIG. 6B shows the x-ray tube and mold of FIG. 6A, with the x-ray tube components assembled for a second heat processing step; and, FIG. 7 is a schematic representation of an oil bath testing arrangement for the tube manufactured in accordance with FIGS. 1–6B.

Referring now to FIG. 7, the evacuated, hermetically solder-sealed micro tubes are removed as shown in FIG. 6B from the alignment molds and the vacuum processing chamber and are ready for use. However, it is typically desirable to high voltage condition the solder-sealed tubes in an oil bath 26 as illustrated. In the illustrated embodiment, the sealed tube assembly 10 is inserted in a bath 26 containing oil 28, for example Shell Dialac. The oil serves to cool the tube and prevent arcs and corona discharge which could damage the tube during conditioning.

The anode 20 is connected to a positive high voltage supply 30, while the electron gun (cathode end) assembly is attached to a grounded transformer capable of supplying 3 VAC across the internal filament. Near the tube a neon bulb is electrically connected to both "sides" or leads of the filament so that if the tube arcs, the neon bulb will flash and hold both sides of the filament at the same potential. Alternately, the neon bulb could be replaced with a transient suppressor (not shown) to protect the filament from arcs. Without the protection of a potential-balancing neon bulb or transiant suppressor, an arc from the anode of the tube to the electron gun body could elevate the body to a high potential which would be quenched in the transformer (inductor), thereby placing a large potential across the filament and possibly burning it out.

Conditioning is done in the following steps. First, with the filament off, the anode 20 is elevated to at least 10 kV above the desired operation voltage. As the voltage is slowly increased, arcs or discharges will occur in the tube. If a continuous glow discharge is observed, it indicates a small leak in the tube and the tube will have to be reprocessed or discarded.

The application of 4 to 5 kV will usually result in some discharge or glow which rapidly diminishes. This glow results from the ionization of residual gases, when ionized by a high potential. The ions are embedded in the tube walls, permanently removing them from the tube.

When the voltage can be raised and rapidly cycled on and off to 10 kV over the maximum desired operation voltage without causing any discharge or drawing any current, the tube is considered to be high voltage conditioned. The above-described illustrative embodiment of a micro tube according to the present invention has successfully been operated at up to 60 kV, without causing any discharge or drawing any current.

If a Geiger counter is used to monitor the tube during conditioning, it will be noticed that during periods of discharge (current draw) x-rays can be detected. Often a tube will exhibit a sustained current draw at a particular voltage. When that voltage is exceeded, the current will rapidly increase until an arc is observed, after which the tube can be returned to the voltage at which the arc was observed without drawing any current and without producing any x-rays. This behavior can be attributed to microscopic sharp point or carbon deposits (from carbonized dust, for example)

which act as emission points for electrons. Once the tube is raised to a particular voltage, it can easily be returned to that voltage because during the initial conditioning the emission points are burnt out.

Once the high voltage conditioning is complete, the filament can be turned on. The filament should be slowly heated while monitoring the electron beam current. Initially, when the filament is brought to a particular voltage, the beam current will rise to a particular level and then over the course of several minutes will gradually fall off. This can be attributed to the electron beam liberating gas molecules from the anode and tube walls. These molecules are ionized and contribute to the beam current. The fall off in this current is due to the gas being captured by the getter and being energetically deposited into the tube walls and components, and due to the finite absorbed gases which can be liberated by the electron beam.

Ultimately, at a particular voltage applied across the filament, a stable and reproducible e-beam current will be observed.

Generally, once a stable beam current is observed at low draw, i.e. 100 (micro) A, the current can be gradually increased to as high as 1 mA beam current. At high current, considerable heat is generated, which must be conducted away.

It will be understood that the foregoing illustrative embodiments are not intended to limit the invention beyond the scope of the appended claims. Accordingly,

I claim:

1. A method for assembling an x-ray tube so that it is demountable, the x-ray tube having a tube body, a cathode, an anode and getter material, the method comprising the following steps:

solder-wetting the surfaces of the cathode which mate with the tube body;

solder-wetting the surfaces of the anode which mate with the tube body;

preassembling the x-ray tube components in an alignment mold, such that the solder-wetted surfaces of the cathode and anode are held apart from the tube body;

placing the alignment mold in a vacuum and heating the x-ray tube;

assembling the heated x-ray tube components in the alignment mold such that the solder wetted surfaces of the cathode and anode are brought into soldering contact with the tube body.

2. The method of claim 1, wherein the heating step involves heating the preassembled x-ray tube to a temperature sufficient to drive gases from the tube, and then continued heating of the assembled tube to a temperature sufficient to further liberate absorbed gases from the interior of the tube and to capture those gases with the getter material such that the getter material continues to capture residual gases in the tube body even when the tube cools.

3. The method of claim 1, wherein the x-ray tube includes an electron gun including a portion defining the cathode, and a filament assembly, such that interior surfaces of the electron gun and the filament assembly mate to form the cathode, and further including the step of solder-wetting the interior surface of the electron gun body so that a solder-seal is formed with the mating interior surface of the filament assembly during the assembly step.

4. The method of claim 1, further including the step of brazing a ring of solder-compatible material onto each end of the tube body prior to the preassembly step.

5. The method of claim 1, wherein the solder applied to the surfaces of the anode and cathode is an indium solder.

6. The method of claim 1, wherein the alignment mold is capable of holding a plurality of x-ray tubes such that a plurality of the x-ray tubes are heated and assembled at the same time.

7. A method for assembling an x-ray tube having a tube body, a cathode secured to one end of the tube body, and an anode secured to the opposite end of the tube body, such that at least one of the anode and cathode is easily demounted from the tube body, wherein the end of the tube body with the demountable anode or cathode is first provided with a metal ring hermetically sealed to the tube body, and then the demountable anode or cathode is solder-sealed to the metal ring in a vacuum environment such that when the x-ray tube is subsequently returned to normal atmospheric pressure a vacuum is maintained in the x-ray tube.

8. The method of claim 7, wherein the step of solder sealing the demountable anode or cathode to the metal ring comprises the further steps of solder wetting the surfaces of the anode or cathode which mate with the metal ring, preassembling the solder-wetted anode or cathode with the metal ring on the x-ray tube body, placing the preassembled x-ray tube components in a vacuum environment and heating the preassembled components, and assembling the heated x-ray tube components in the vacuum environment such that the solder-wetted surfaces of the anode or cathode are brought into soldering contact with the metal ring.

9. The method of claim 7, wherein the x-ray tube body is provided with a getter material activated by solder-sealing temperatures, the getter material being sealed inside the tube body during the step of solder-sealing the demountable anode or cathode to the metal ring in a vacuum environment and activated by the temperature of the solder-sealing step such that it acts as a consumable vacuum pump inside the sealed tube when the tube is returned to normal atmospheric pressure.

10. An x-ray tube comprising a tube body, a cathode on one end of the tube body, and an anode on the opposite end of the tube body, wherein the cathode includes a replaceable filament assembly comprising a filament electron source and a consumable getter material, the cathode further being secured and hermetically sealed to the tube body with solder such that the cathode with its replaceable filament assembly is designed to be demountable from the x-ray tube and resealed to the x-ray tube with solder.

11. The apparatus of claim 10, wherein a metal ring is secured to the cathode end of the tube body, and the cathode is soldered to the metal ring.

12. The apparatus of claim 11, wherein the metal ring is brazed to the cathode end of the tube body.

13. The apparatus of claim 10, wherein the replaceable filament assembly is removably soldered to the cathode.

14. The apparatus of claim 13, wherein the removable filament assembly comprises a pin-type electrical feedthrough, a getter-filled tube secured to an interior end of a pin of the pin-type electrical feedthrough, and a filament electrically connected to the getter-filled tube.

15. An x-ray tube comprising a tube body, a cathode secured to one end of the tube body, and an anode secured to the opposite end of the tube body, wherein at least one of the cathode and anode is secured to its respective tube end by a metal ring secured directly to the tube body end and by a vacuum-soldered seal to the metal ring.

16. The apparatus of claim 15, wherein the metal ring is brazed to the tube body end.

17. A demountable x-ray tube comprising a tube body, a cathode on one end of the tube body, an anode on the opposite end of the tube body, an electron gun, and a filament assembly and getter material in the tube body, wherein at least the cathode is secured and hermetically sealed to the tube body with solder, the interior surfaces of the electron gun body and the filament assembly mate and one end of the electron gun forms the cathode, the interior mating surfaces of the filament assembly and electron gun body are secured and hermetically sealed with solder, and an exterior surface of the electron gun body forms a cathode surface which is secured and hermetically sealed to the tube body with solder.

18. The apparatus of claim 17, wherein both the anode and cathode are secured and hermetically sealed to the tube body with solder.

* * * * *

Signed and Sealed this

First Day of May, 2001

*Attest:*

Nicholas P. Godici

NICHOLAS P. GODICI

*Attesting Officer*

*Acting Director of the United States Patent and Trademark Office*